US006149455A

United States Patent [19]

Levi

[11] Patent Number: 6,149,455

[45] Date of Patent: Nov. 21, 2000

[54] DEVICE FOR CLAMPING THE CABLE IN ELECTRICAL OUTLETS OR PLUGS

[75] Inventor: Bruno Levi, Brescia, Italy

[73] Assignee: Palazzoli S.p.A., Italy

[21] Appl. No.: 09/182,266

[22] Filed: Oct. 29, 1998

[30] Foreign Application Priority Data

| | | | |
|---|---|---|---|
| Dec. 3, 1997 | [IT] | Italy | BS97U0118 |
| Feb. 6, 1998 | [IT] | Italy | BS98U0015 |
| Mar. 25, 1998 | [IT] | Italy | BS98U0029 |

[51] Int. Cl.[7] ..... H01R 13/00; H01R 13/62

[52] U.S. Cl. ..... 439/462; 439/461; 439/321

[58] Field of Search ..... 439/462, 461, 439/321

[56] References Cited

U.S. PATENT DOCUMENTS

| | | | |
|---|---|---|---|
| 3,989,340 | 11/1976 | Sheldon et al. | 439/462 |
| 5,435,760 | 7/1995 | Miklos | 439/321 |

FOREIGN PATENT DOCUMENTS

| | | |
|---|---|---|
| WO 0 175 827 | 9/1984 | European Pat. Off. . |
| WO 93/06637 | 4/1993 | European Pat. Off. . |
| 94 20 977 | 4/1995 | Germany . |
| 612 797 | 8/1977 | Switzerland . |

*Primary Examiner*—Paula Bradley
*Assistant Examiner*—Edwin A. León
*Attorney, Agent, or Firm*—McGlew and Tuttle, P.C.

[57] ABSTRACT

An electrical outlet or plug includes a body, which encloses a connecting jack, which can be connected to a cable, and a grip element for clamping the cable. The body and grip element are provided with complementary features, which limit the axial unthreading movement of the latter in relation to the former and for preventing their disconnection once they have been connected. A locking nut is joined to the grip element axially, with the possibility of remaining joined to the said grip element, and through this, to the body when the nut is completely unscrewed and removed. Structure is also provided for preventing the unscrewing rotation of the nut once it has been screwed down.

18 Claims, 6 Drawing Sheets

DEVICE FOR CLAMPING THE CABLE IN ELECTRICAL OUTLETS OR PLUGS

FIELD OF THE INVENTION

The present invention pertains to the electrical outlets or plugs for industrial and/or tertiary use with a device for clamping the electrical cable in such devices.

BACKGROUND OF THE INVENTION

In general, the electrical outlets or plugs for industrial and/or tertiary use comprise a body and a connecting jack. The latter is enclosed in the body and may have connection openings in the case of an outlet or pins in the case of a plug that are turned towards one end of the body. The openings or pins of the jack are then connected to the corresponding electric wires of a cable, which enter from the opposite end of the body.

To prevent the detachment of the electric wires from the jack, the cable is usually clamped in the body. Up to now, this clamping was carried out using various systems, but usually with a tie-type clamping cable, i.e., with a band which is placed in the body or is attached to the jack and which is tightened around the cable by means of at least one clamping screw.

However, this system is neither easy nor practical to carry out since it involves the means inside the body and always requires the use of a tool, such as a screwdriver, both for clamping and for releasing.

SUMMARY AND OBJECTS OF THE INVENTION

The primary object of the present invention is to propose a device for clamping the cable in electrical outlets or plugs, which is simpler, easier, and is able to facilitate the clamping/release of the cable even without the availability of tools.

Another object of the present invention is to propose a device to clamp the cable in electrical outlets or plugs which advantageously uses such parts of the outlet or plug body for the clamping, without, i.e., resorting to additional and complex components.

Another object is to propose an electrical outlet or plug having a device for clamping the cable, which also incorporates means capable of preventing its accidental release, when the cable is clamped, to prevent an unintentional and uncontrolled detachment of the clamping elements when they are in the release position for the insertion or removal of the cable in the outlet or plug.

The objects are accomplished, according to the present invention, with a device that essentially comprises a grip element arranged in the body of the outlet or plug, between this body and a threaded locking nut, on the inlet side of the cable, the grip element being joined with the body by means of a conical connection and being tightened around the cable to be clamped after screwing the locking nut onto the body.

Also, all the elements are advantageously connected axially without cross components, which especially simplifies their structure and facilitates their embodiment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
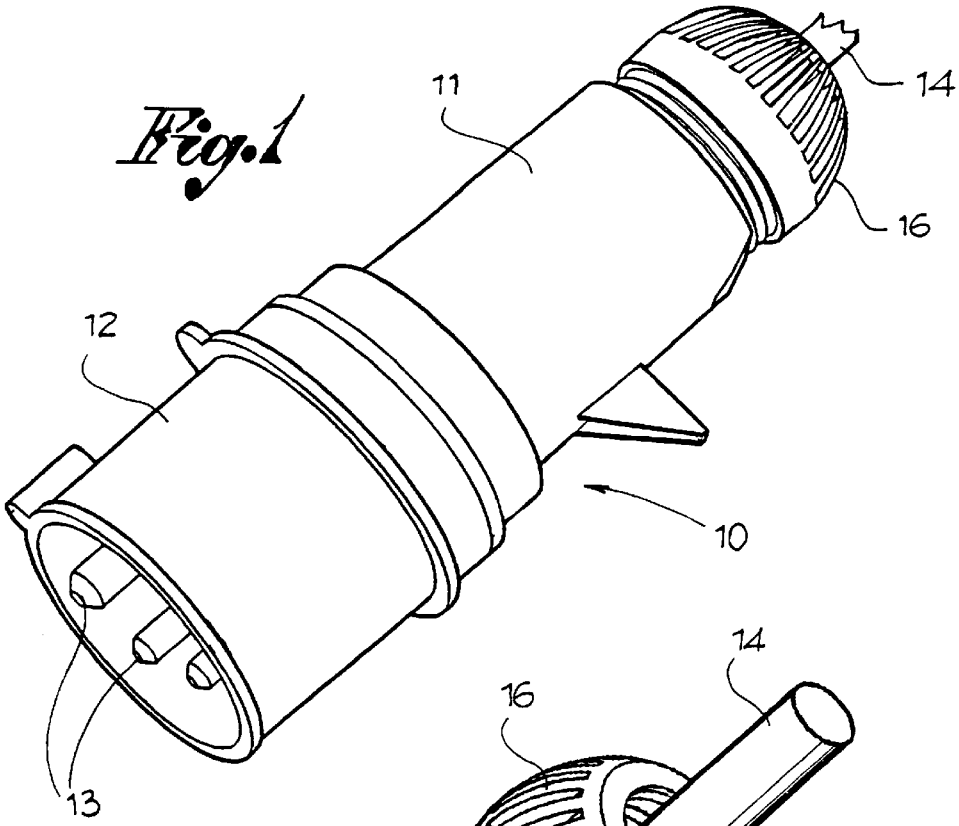
FIG. 1 is a perspective view showing an example of an electrical plug which is assembled and is attached to a cable.

Referring to the drawings in particular, an electrical plug, which includes a body or grip 11 and a holding element 12. Grip 11 and holding element 12 are joined to one another and enclose a connecting jack, which, in the case shown, is shown with the pins 13 (FIG. 1) and is indicated globally as 10. The electric wires assembled in a cable 14, which enters the body 11 through the free end, are connected to the connecting jack 10.

Figure 2:
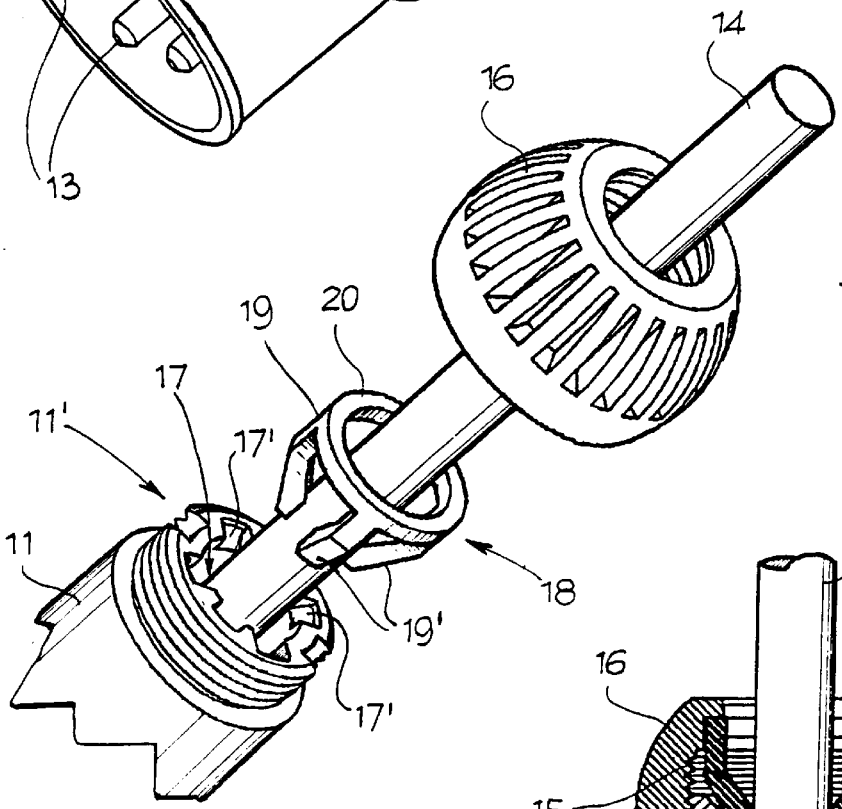
FIG. 2 is an exploded perspective view of a part of the plug body and the means for clamping the cable in a first embodiment.

A collar 11', which has, on the outside, a threading 15 on which a locking nut 16 is screwed and, on the inside, a seat 17 with the conical grooves 17' in the longitudinal direction, is provided at this end of the element of the body 11 (see FIG. 2).

A grip clamp element 18, which has the flexible jaws 19 that extend from an annular portion 20, is mounted between the collar 11' and the nut 16, concentrically to the cable 14.

The jaws 19 have at least one conical part 19' and are turned towards the seat 17 in the collar 11' of the body, fitting into the conical grooves 17'.

On the other hand, the annular portion 20 of the grip element 18 is turned towards, and interacts with, an annular striking surface 21, which is provided inside the nut 16.

Thus, to clamp the cable 14 once the plug (or outlet) has been assembled and wired, it is only necessary to screw the nut 16 onto the threaded collar 11' of the body. Then, the jaws 19 of the grip element 18, pushed by the nut 16, interact with the conical grooves 17' and they are forced to tighten around the cable 14, clamping it. It should be noted that the connection of the jaws 19 with the grooves 17' in the conical seat 17 prevents the rotation of the grip with the nut during the screwing down of same, thus avoiding subjecting the cable to undue twisting.

Figure 4:
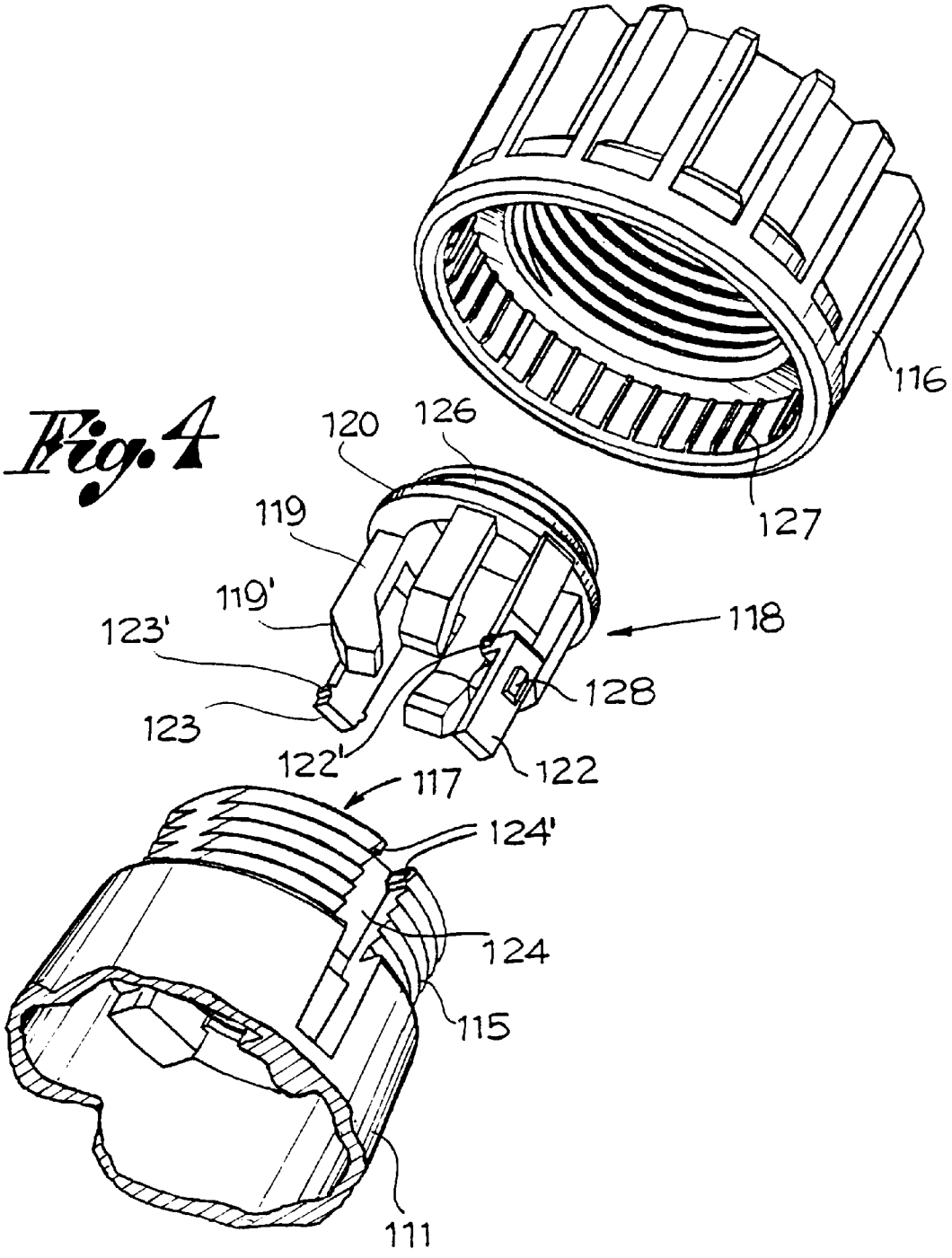
FIG. 4 is an exploded perspective view of a part of the body of the outlet or plug, the grip element and the locking nut in another embodiment.
Figure 5:
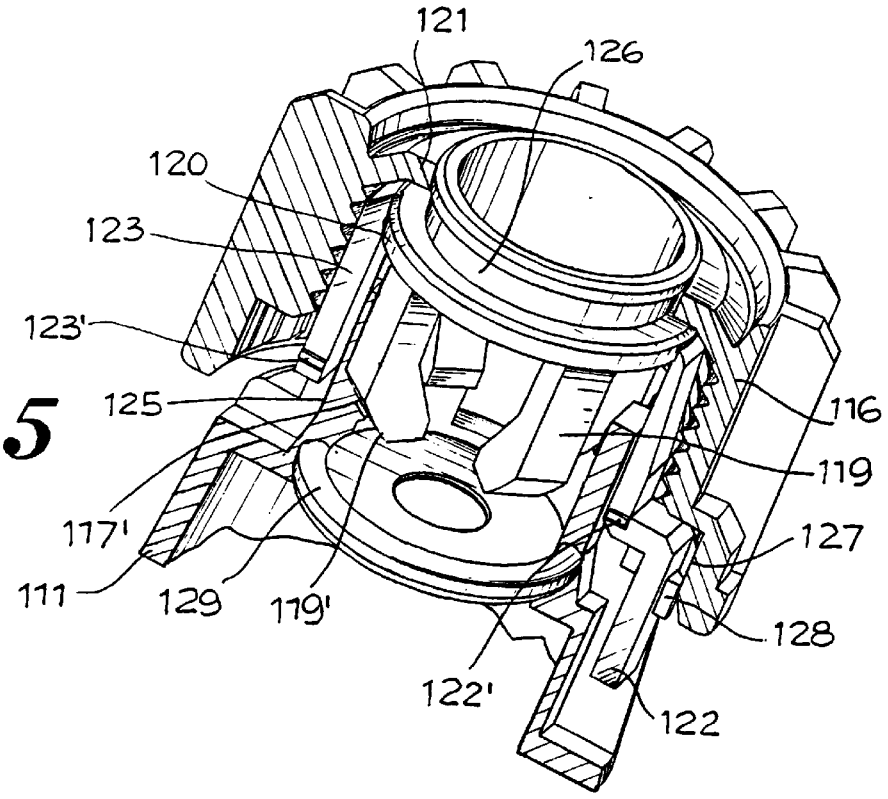
FIG. 5 is a cross sectional view of the components illustrated in FIG. 4, but assembled.
Figure 6:
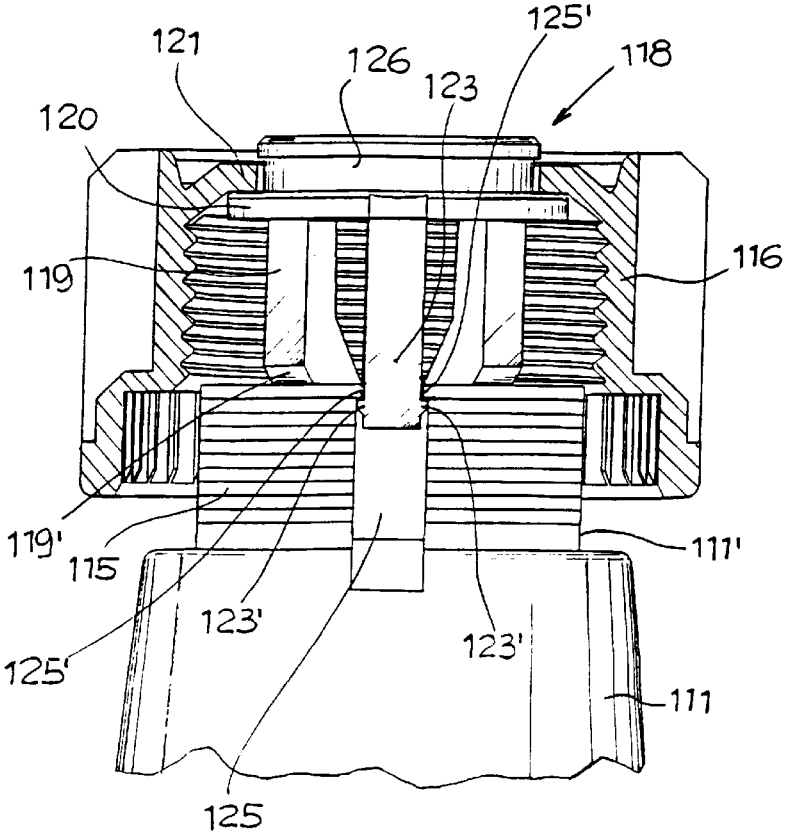
FIG. 6 is an axial sectional view of the clamping device but in the release position, in which the nut and grip element are in the withdrawn position in relation to the body, and they remain, however, joined to this body.
Figure 7:
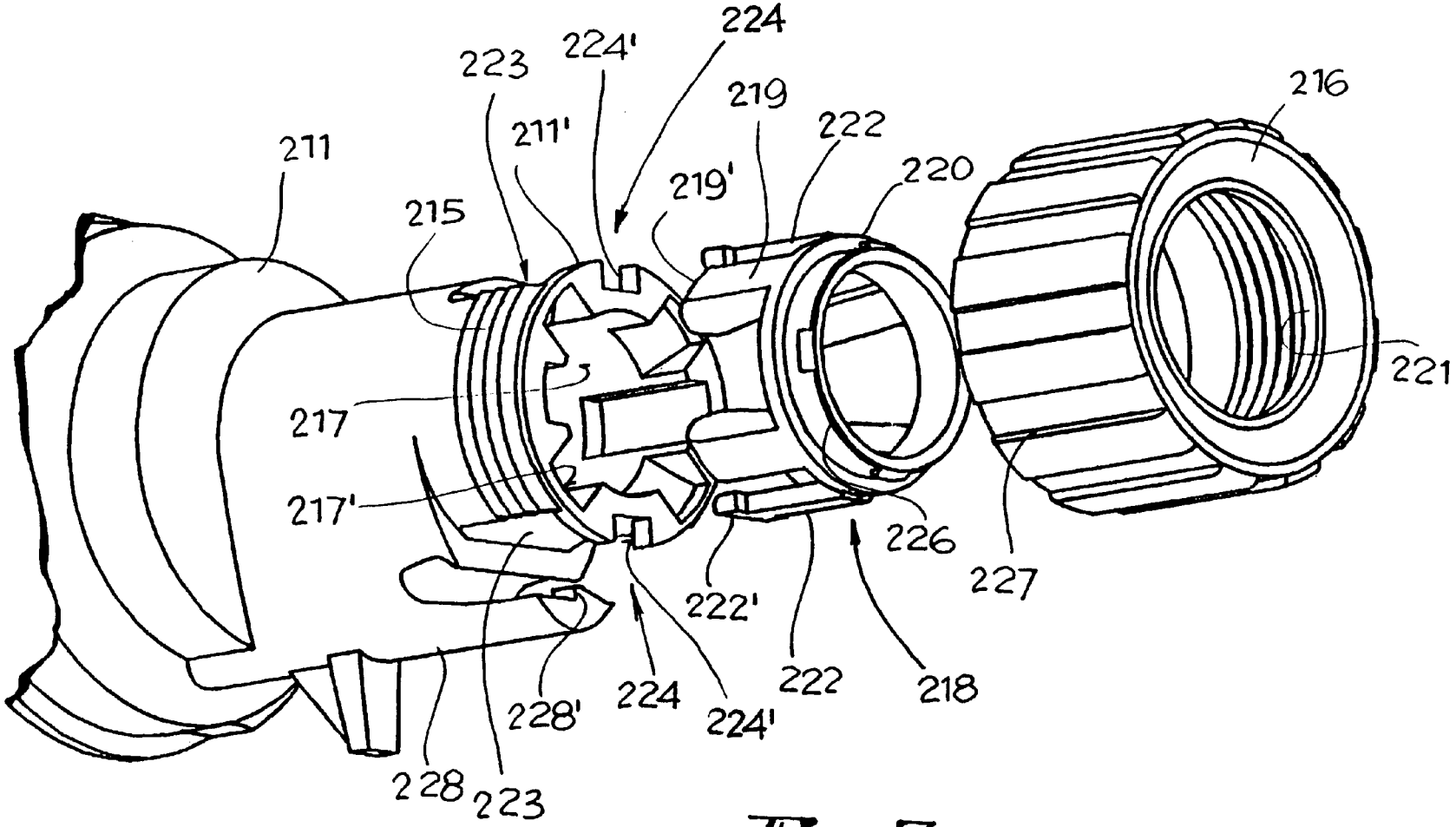
FIG. 7 is an exploded view showing a part of the body of the outlet or plug, the grip element and the locking nut in another embodiment.
Figure 8:
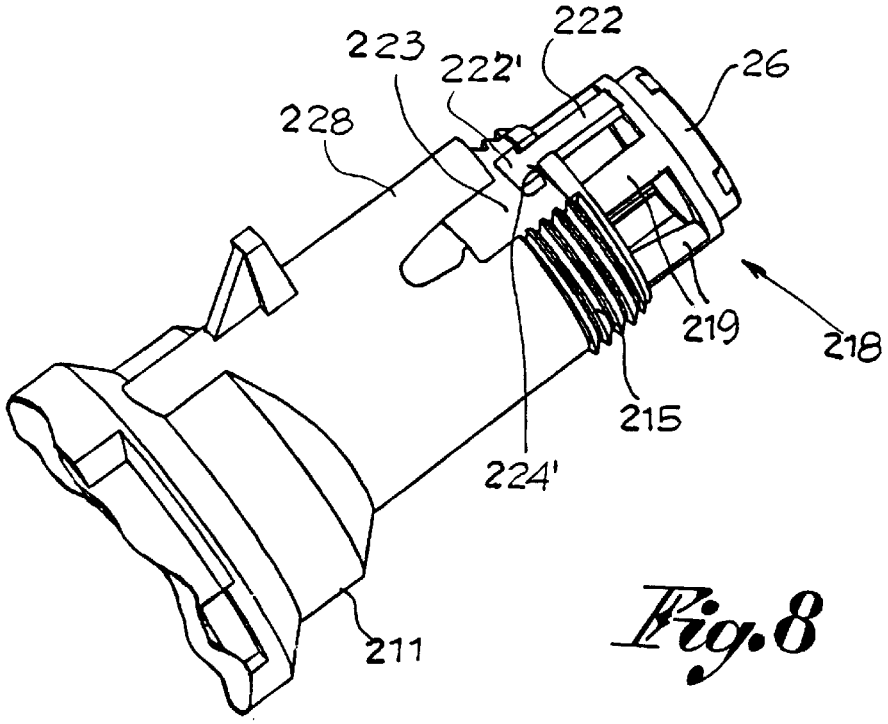
FIG. 8 is a perspective cut away view showing the connection of the grip element with the body of the outlet or plug according to the embodiment of FIG. 7.
Figure 9:
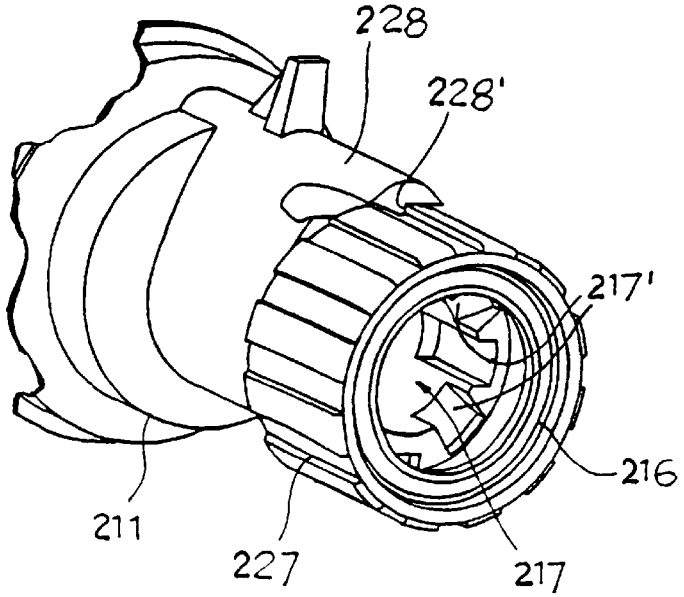
FIGS. 9 is a perspective view showing components of the outlet or plug of FIG. 7 assembled.
Figure 10:
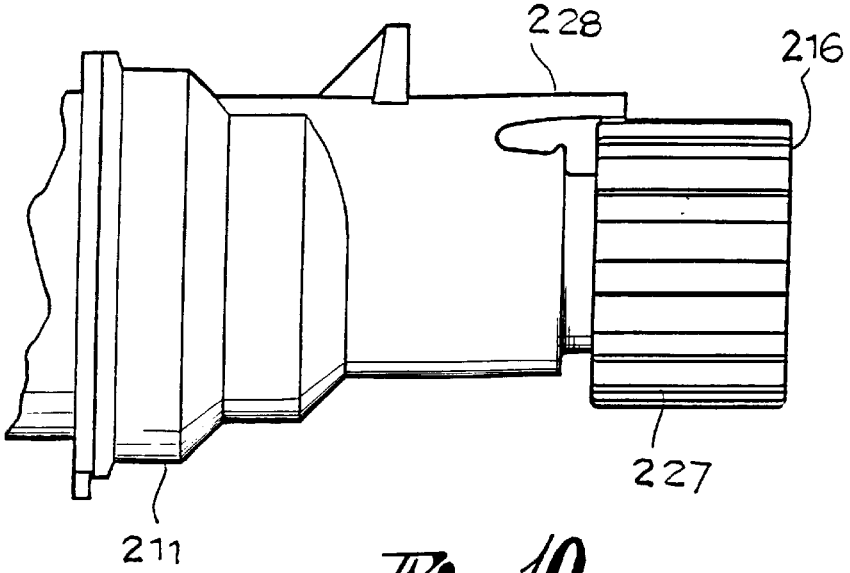
FIGS. 10 is a lateral view of all the components of the outlet or plug of FIG. 7 assembled, respectively.
Figure 11:
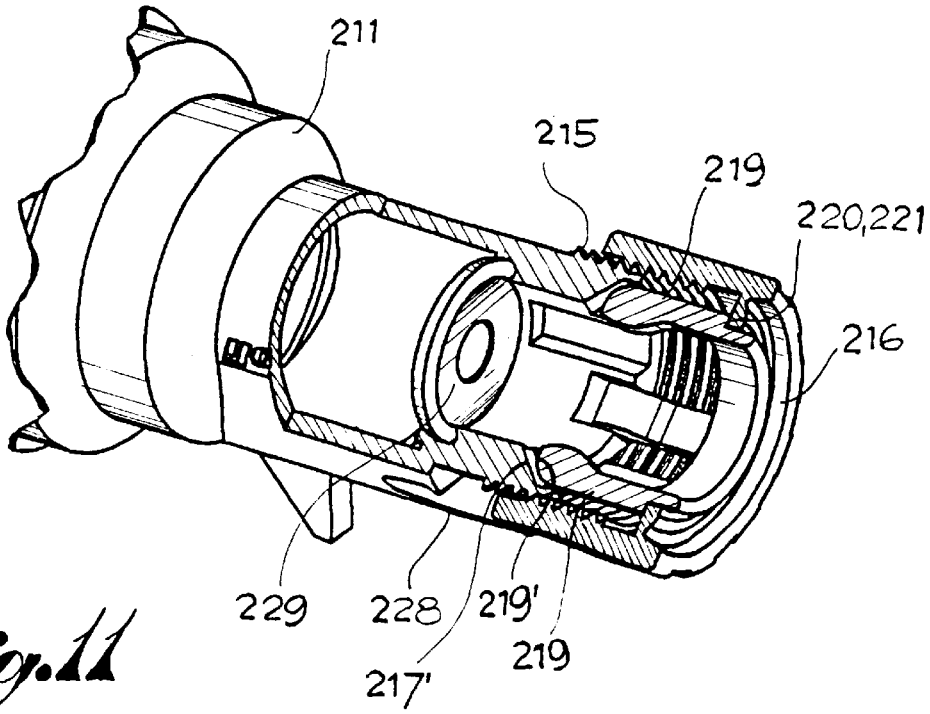
FIG. 11 is a longitudinal perspective sectional view of the unit of FIGS. 9 and 10.

In the exemplary embodiment of FIGS. 4–6, the body 111 of an electrical outlet or plug is shown only partially in its end part, in which it has a collar 111' with an external threading 115, onto which a locking nut 116 is screwed. A seat 117 which has conical (as used herein, slanted so as to generally corresponding to a conical shape) grooves 117' in the longitudinal direction is also provided in the body 111, and a grip element 118 is mounted between the collar 111' and the nut 116 for clamping the electric cable, which is passed through there centrally.

Figure 3:
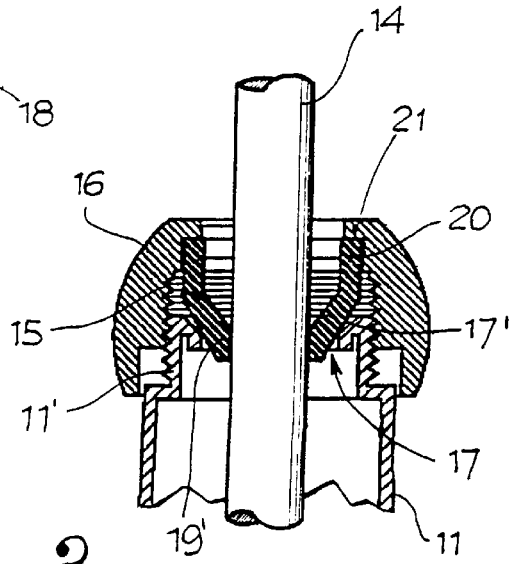
FIG. 3 is a sectional view of the device of FIG. 2 with the cable in the clamped state.

Similarly to that described for FIGS. 1–3, the grip element 118 has the flexible jaws 119 that come from an annular portion 120 and that have a conical portion 119', which is intended to be joined with the conical grooves 117 in the collar of the body.

The annular portion 120 of the grip element 118 is turned towards, and interacts with, an annular striking surface 121 inside the locking nut 116.

In this embodiment, the grip element 118 is also provided with one or, more preferably, two diametrically opposed tongues 122, 123, which are parallel to its jaws 119 and are intended to be inserted in corresponding indentations 124, 125 provided on the outside of the body 111. A first tongue 122 may be in the form of an attachment to the grip element 118, lying halfway between two contiguous jaws 119, projecting towards the outside of same. The second tongue 123 is in a position halfway between two contiguous jaws 119, but moved outwardly in relation to same and extending from the annular portion 120.

The first tongue 122 is longer than the second tongue 123, and correspondingly, the indentation 124 intended to accommodate it is longer than the indentation 125 provided for the other tongue 123, and the longer tongue protrudes from the opening of the nut 116.

Two lateral locking teeth 122', 123' are provided on the sides of each tongue 122, 123, respectively.

Two opposing teeth 124', 125', which are turned towards one another, are provided on the sides of each indentation 124, 125, close to the free end of the collar 111', respectively.

The tongues 122, 123 of the grip element 118 (FIGS. 4 and 6) are inserted by force into the respective indentations 124, 125 of the body 111, so that the element may slide axially in relation to the body.

However, in the direction of unthreading the grip element 118, the lateral teeth 122', 123' of the tongues 122, 123 strike against the teeth 124', 125' on the sides of the indentations 124, 125 so as to stop the element proper, thus preventing its detachment from the body 111 of the outlet or plug.

On the other hand, even the locking nut 116 remains joined in the axial direction to the grip element 118 and, through this, to the body 111 of the outlet or plug. To this end, the internal edge of the annular striking surface 121 of the nut 116 is provided for being inserted by force into a groove 126, which is present around a protuberance of the grip element lying above the annular portion 120 of same. This connection then makes possible the rotation of the nut in relation to the grip element for screwing and unscrewing onto the threaded section of the collar of the body 111 and, as stated above, to keep the nut and grip element joined to one another and to the body 111.

Also according to the present invention, a toothed crown 127 is provided inside the nut 116, close to its opening, and a stop tooth 128 that is intended to interact with the toothing 127 is provided on the outer face of the longer tongue 122.

The stop tooth 128 is so as to make possible the unidirectional rotation from left to right of the nut 116 for its screwing onto the threaded collar 111' of the body 111 and, on the other hand, to prevent the opposite rotation of the nut for its unscrewing. Thus, the nut 116 can be screwed to the bottom for the clamping of the cable through the grip element, but cannot be loosened and be unscrewed uncontrollably due to an unintentional release of the cable. In fact, to unscrew the nut, it is necessary to act intentionally using a tool on the tongue 122 in the manner of pushing it inwards and of keeping the stop tooth 128 disconnected from the toothing 127 during the unscrewing operation, which thus can only be intentional.

Thus, the nut 116, once it has been screwed down to clamp the cable by means of the grip element, cannot be unscrewed by unclamping the cable in an uncontrolled manner, and the nut and grip element remain permanently joined to one another and to the body of the outlet or plug.

It should also be noted that a ring seal 129, through which the cable passes and which guarantees the sealing around same below the grip element, may be mounted inside the body without being affected by the clamping and unclamping means.

In the embodiment of FIGS. 7–11 as well, the body 211 of an electrical outlet or plug is shown only partially in its end part, in which it has a collar 211' with an outer threaded section 215 onto which a locking nut 216 is screwed. A seat 217, which has conical grooves 217' in the longitudinal direction, which are narrowed towards the inside of the body, is provided in the body 211.

A grip element 218 is mounted between the collar 211' and the nut 216 for clamping the electrical cable, which is passed through there centrally and which extends through a seal 229.

Here as well, the grip element 218 has flexible jaws 219, which come from an annular portion 220 and which have a conical portion 219' intended to be joined to the conical grooves 217' in the collar of the body.

The annular portion 220 of the grip element 218 is also turned towards, and interacts with, an annular striking surface 221 inside the nut 216, so that the element is pushed into the body when the nut is screwed onto the threaded section 215.

In this case, the grip element 218 is provided with two tongues 222 to limit the unthreading of the element proper from the body 211. The tongues 222 are identical, diametrically opposite, placed between two contiguous jaws, and moved outwardly in relation to same. These tongues 222 are intended to be inserted and to slide in corresponding indentations 224 provided on the outside of the collar 211' of the body 211, corresponding to two flattened sections 223. Each tongue 222 has two lateral locking teeth 222' while two opposing steps 224' are provided on the sides of each indentation 224, close to the free end of the collar 211'.

The tongues 222 of the grip element 218 are inserted in the respective indentations 224 of the collar 211' so that the element may slide axially in relation to the body. However, in the unthreading direction of the grip element 218, the lateral teeth 222' of the tongues 222 strike against the steps 224' on the sides of the indentations 224 so as to stop the element proper, thus preventing its detachment from the body 211 of the outlet or plug.

In addition, the locking nut 216 remains joined in the axial direction to the grip element 218 and, through this grip element 218, to the body 211 of the outlet or plug. To this end, the internal edge of the annular striking surface 221 of the nut 216 is provided for being inserted by force into a groove 226, which is present around a protuberance of the grip element lying above the annular portion of same, and this groove 226 may be defined by a continuous collar or one with sections, as shown in the drawings.

The connection then makes possible the rotation of the nut 216 in relation to the grip element 218 for screwing and unscrewing on the threaded section 215 of the collar of the body; however, the nut and grip element are kept joined to one another and, through the tongues 222, to the body of the outlet or plug.

According to another feature, the outer surface of the nut 216 has a toothing or broaching 227, and the body 211, on one side of the collar 211', in the longitudinal direction, is provided with a lug, which extends above one of the lateral flattened sections 223 of the collar 211' and on the outside of the nut 216 when same is screwed onto the collar proper. A stop tooth 228' (FIGS. 7–9), which is intended to engage with the outer toothing or broaching 227 of the nut 216, is provided on the internal surface of the lug 228.

The stop tooth 228' of the lug 228 is so as to make possible the unidirectional rotation (from left to right) of the nut for its screwing onto the threaded collar 211' of the body 211 and, on the other hand, to prevent the opposite rotation of the nut for its unscrewing. Therefore, the nut 216 can be screwed to the bottom for clamping the cable through the grip element, but it cannot be loosened and unscrewed in an uncontrolled manner due to an unintentional release of the cable.

In fact, to unscrew the nut, it is necessary to act intentionally using a tool on the lug 228 in the manner of moving it away from the nut to disconnect its stop tooth 228' from the outer toothing 227 of the nut during the unscrewing operation, which, thus, can only be intentional.

While specific embodiments of the invention have been shown and described in detail to illustrate the application of the principles of the invention, it will be understood that the invention may be embodied otherwise without departing from such principles.

What is claimed is:

1. A device for clamping a cable in an electrical outlet or plug, the device comprising:

a body that encloses a connecting jack that can be connected to the cable to be clamped;

a threaded locking nut;

a grip element which is arranged in said body between said body and said threaded locking nut on an inlet side of the cable, said gripping element including a plurality of flexible jaws;

a conical connection joining said grip element to said body, said grip element being tightened around said cable to be clamped after said locking nut is screwed onto said body, wherein said grip element is provided with two tongues, which are parallel to said jaws and are intended to be inserted and to slide in corresponding indentations on an outside of said body, and in which said tongues have lateral locking teeth, which are intended to intercept opposing teeth on sides of said indentations in order to prevent the detachment of said grip element when said grip element is stopped in relation to said body, said conical connection including a substantially conical seat formed of grooves which are intended to accommodate said flexible jaws of said grip element and to prevent rotation of said grip element with said locking nut.

2. The device in accordance with claim 1, wherein said grip element includes an annular portion with said flexible jaws of said grip element extending away from said annular portion towards an inside of said body, said conical seat interacting with said jaws, and said nut having a flat seat for supporting said annular portion of said grip element.

3. The device in accordance with claim 1, wherein said grip element includes an annular portion with said flexible jaws turned towards an outside of said body, said body having a flat seat for supporting said annular portion, and said nut having a conical seat which interacts with said jaws of said grip element.

4. The device in accordance with claim 1, further comprising a seal placed in said body, said seal including a part that is made in one piece with said body proper and acts around the cable, adapting to the cable without a need for intervention.

5. The device in accordance with claim 1, wherein said body has, on said inlet side of the cable, a collar which has an external threaded section, said locking nut being screwed onto said external threaded section, said conical seat being internal and interacting with said grip element for tightening said grip element around said cable when said nut is screwed onto said external threaded section.

6. The device in accordance with claim 5, wherein:

said grip element has said flexible jaws extending from an annular portion;

said flexible jaws have at least one conical part turned towards and being joined to said conical seat;

said annular portion is towards and interacts with an annular striking surface inside said locking nut.

7. A device in accordance with claim 1, wherein said body and said grip element are provided with complementary limiting means to limit axial movement of said body and said grip element and to prevent disconnection of said body and said grip element once they have been connected and said locking nut is unscrewed from said body;

said locking nut and said grip element are joined axially with the possibility for said nut to rotate in relation to said grip element, but to remain joined to said grip element and, through this, to said body when said nut is completely unscrewed and removed; and said locking nut and said grip element include means which interact to make possible a unidirectional rotation for screwing and to prevent the opposite rotation for unscrewing when said nut is screwed onto said body for clamping said cable with said grip element.

8. The device in accordance with claim 7, wherein one of said tongues is longer than the other;

said indentations on the outside of said body have a length that is adapted to that of said tongues; and a longer of said tongues protrudes from an opening of said locking nut.

9. The device in accordance with claim 1, wherein:

said body and said grip element are provided with complementary means which interact to limit an axial movement in terms of an unthreading of said grip element in relation to said body and to prevent relative disconnection once said body and said grip element have been connected;

said locking nut and said grip element are joined axially with a possibility for said nut to rotate in relation to said grip element and to remain joined to said grip element and, through this, to said body even when said locking nut is completely unscrewed and removed;

said locking nut and said grip element have means which interact to make possible a unidirectional rotation of screwing and to prevent an opposite rotation of unscrewing when said nut is screwed onto said body for clamping the cable through the grip element.

10. The device in accordance with claim 9, wherein said locking nut has an internal collar with an edge that rests in an annular groove, which is present around a protuberance at the end of said grip element for the axial connection between said grip element and said nut.

11. The device in accordance with claim 9, wherein said grip element is provided with two tongues which are parallel to jaws of said grip element intended to be inserted and to slide in corresponding indentations on an outside of a collar of said body, said tongues having lateral locking teeth for intercepting striking steps on sides of said indentations in order to prevent a detachment of said grip element when said grip element is moved back in relation to said body, said locking nut having an internal collar with an edge resting in an annular groove provided around a protuberance at an end of said grip element for an axial connection between said grip element and said nut, said toothing interacting with a stop tooth on said lug that is made in one piece with said body, is parallel to and on the outside of said collar, said stop tooth being shaped to engage with said toothing provided on an outside of said locking nut and to make possible the rotation of said nut only in a direction of screwing and not in a direction of unscrewing.

12. The device in accordance with claim 9, wherein said grip element is provided with two tongues said tongues being parallel to jaws of said grip element, said two tongues being intended to be inserted and to slide in corresponding indentations on an outside of said collar of said body, said tongues having lateral locking teeth for intercepting said striking steps provided on the sides of said indentations for preventing detachment of said grip element when same is moved back in relation to said body.

13. The device in accordance with claim 12, wherein a toothing is provided that interacts with said stop tooth on a lug made in one piece with said body, said toothing being parallel to and on an outside of said collar, said stop tooth being shaped to engage with said toothing and to make possible a rotation of said nut only in a direction of screwing and not in a direction of unscrewing, said toothing being provided on an outside of said locking nut.

14. A device for clamping a cable in an electrical outlet or plug, the device comprising:

a body that encloses a connecting jack that can be connected to the cable to be clamped;

a threaded locking nut;

a grip element which is arranged in said body between said body and said threaded locking nut on an inlet side of the cable;

a conical connection joining said grip element to said body, said grip element being tightened around said cable to be clamped after said locking nut is screwed onto said body;

said body and said grip element are provided with complementary limiting means to limit axial movement of said body and said grip element and to prevent disconnection of said body and said grip element once they have been connected and said locking nut is unscrewed from said body;

said locking nut and said grip element are joined axially with the possibility for said nut to rotate in relation to said grip element, but to remain joined to said grip element and, through this, to said body when said nut is completely unscrewed and removed; and said locking nut and said grip element include means which interact to make possible a unidirectional rotation for screwing and to prevent the opposite rotation for unscrewing when said nut is screwed onto said body for clamping said cable with said grip element, wherein said grip element is provided with two tongues, which are parallel to a plurality of flexible jaws and are intended to be inserted and to slide in corresponding indentations on an outside of said body, and in which said tongues have lateral locking teeth, which are intended to intercept opposing teeth on sides of said indentations in order to prevent the detachment of said grip element when said grip element is stopped in relation to said body.

15. The device in accordance with the claim 14, wherein said locking nut has an internal collar with an edge resting in an annular groove, said annular groove is provided around a protuberance at a top of said grip element providing an axial connection between said grip element and said nut.

16. The device in accordance with the claim 14, wherein a toothing is provided inside said locking nut close to an opening of said locking nut, said toothing interacting with a stop tooth provided on one of said tongues, said stop tooth being shaped to engage with said toothing and to make possible the rotation of said nut only in a direction of screwing and not in a direction of unscrewing.

17. The device in accordance with claim 16, wherein said stop tooth is on an outside of a longer of said tongues which may be unfastened from said toothing only by pushing said longer tongue inwards with a tool, engaging the wall of the tongue protruding from the nut.

18. A device for clamping a cable in an electrical outlet or plug, the device comprising:

a body that encloses a connecting jack that can be connected to the cable to be clamped;

a threaded locking nut;

a grip element which is arranged in said body between said body and said threaded locking nut on an inlet side of the cable;

a conical connection joining said grip element to said body, said grip element being tightened around said cable to be clamped after said locking nut is screwed onto said body;

a seal placed in said body, said seal including a part that is made in one piece with said body proper and acts around the cable, adapting to the cable without a need for intervention, wherein said grip element is provided with two tongues, which are parallel to a plurality of flexible jaws and are intended to be inserted and to slide in corresponding indentations on an outside of said body, and in which said tongues have lateral locking teeth, which are intended to intercept opposing teeth on sides of said indentations in order to prevent the detachment of said grip element when said grip element is stopped in relation to said body.

* * * * *